United States Patent [19]

Johnson et al.

[11] Patent Number: 4,684,204

[45] Date of Patent: Aug. 4, 1987

[54] ELECTRON SOURCE ASSEMBLY WITH A REPLACEABLE FILAMENT RIBBON

[75] Inventors: Bruce S. Johnson, San Mateo; Dennis M. Taylor, Santa Clara, both of Calif.

[73] Assignee: Finnigan Corporation, San Jose, Calif.

[21] Appl. No.: 830,671

[22] Filed: Feb. 18, 1986

[51] Int. Cl.[4] ..... H01J 1/18

[52] U.S. Cl. ..... 439/863; 313/237; 313/271; 445/29; 439/807

[58] Field of Search ..... 445/29, 32; 29/854; 313/237, 271, 278; 361/426; 339/273 R, 273 F, 276 S

[56] References Cited

U.S. PATENT DOCUMENTS

| | | | |
|---|---|---|---|
| 1,716,930 | 6/1929 | Prindle | 313/278 X |
| 2,479,221 | 8/1949 | Eaton | 313/271 |
| 2,935,551 | 5/1960 | Wells | 339/273 R |

FOREIGN PATENT DOCUMENTS

| | | | |
|---|---|---|---|
| 1935373 | 1/1971 | Fed. Rep. of Germany | 339/273 F |

*Primary Examiner*—Kenneth J. Ramsey

*Attorney, Agent, or Firm*—Flehr, Hohbach, Test, Albritton & Herbert

[57] ABSTRACT

A filament assembly which includes spaced posts with slotted ends for positioning a filament. The ends of the filament are secured to the posts in tapered holes which receive a pin or screw to provide electrical contact and tension the filament.

3 Claims, 6 Drawing Figures

ELECTRON SOURCE ASSEMBLY WITH A REPLACEABLE FILAMENT RIBBON

This invention relates generally to an electron source and more particularly to a replaceable filament assembly for an electron source.

Electron sources for supplying electrons to ion sources in mass spectrometers employ heated filaments. These sources are generally disposed within the evacuated cavity adjacent to the ionization chamber. In one type of source, when the filaments are burned out, the entire filament assembly is replaced and the old assembly discarded. In another type, the filament is spot welded across spaced, small diameter feed through posts. The welding of the filament to the posts is prone to manufacturing error by excess welding current and unrepeatable tensioning of the filament. When the filament burns out, a new filament is spot welded across the posts. This requires a skilled operator, and field installed filaments are even more susceptible to failure because of poor welding and tensioning.

It is a general object of the present invention to provide an improved filament assembly.

It is an object of the present invention to provide a filament assembly in which the filament can be replaced in the field with repeatable positioning and tensioning.

The foregoing and other objects of the invention are achieved by a filament assembly which includes spaced posts with slotted ends for positioning the filament. The ends of the filament are retained in tapered holes by means of pins or screws which act to tension the filament and provide electrical contact when inserted into the tapered holes and which are removable for replacing a filament.

The invention is described in the following specification and illustrated in the accompanying drawings of which:

Figure 1:
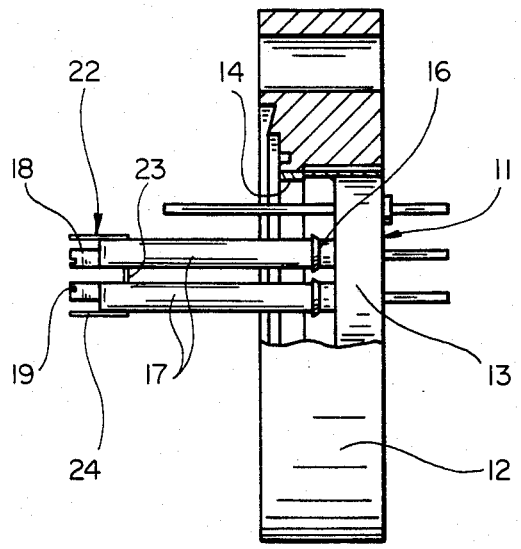
FIG. 1 is a side elevational view partly in section of a filament assembly in accordance with the present invention taken generally along the line A —A of FIG. 2.
Figure 2:
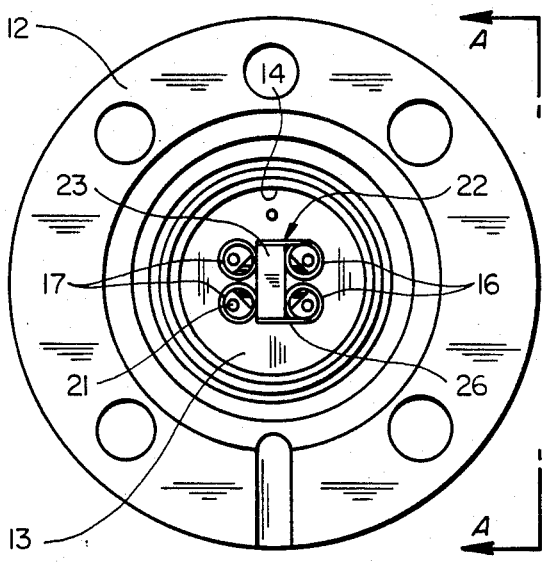
FIG. 2 is a plan view of a filament assembly in accordance with the invention.

The filament assembly of the present invention includes a header 11 mounted on a flange 12 by welding. The header includes a ceramic disc 13 brazed to outer cylinder 14 which permits attachment of the header to the flange 12. A plurality of pass through posts are secured to the ceramic disc. The pass through posts comprise cylindrical members 16 suitably brazed to the ceramic disc and which in turn are secured to the posts 17 to provide for connection of the posts outside of the vacuum envelope.

Thus, when the flange is suitably sealed to the spectrometer housing, there is formed a competent vacuum seal with the posts 17 extending into the vacuum chamber to provide electrical connection to the filament, as will be described.

Figure 3:
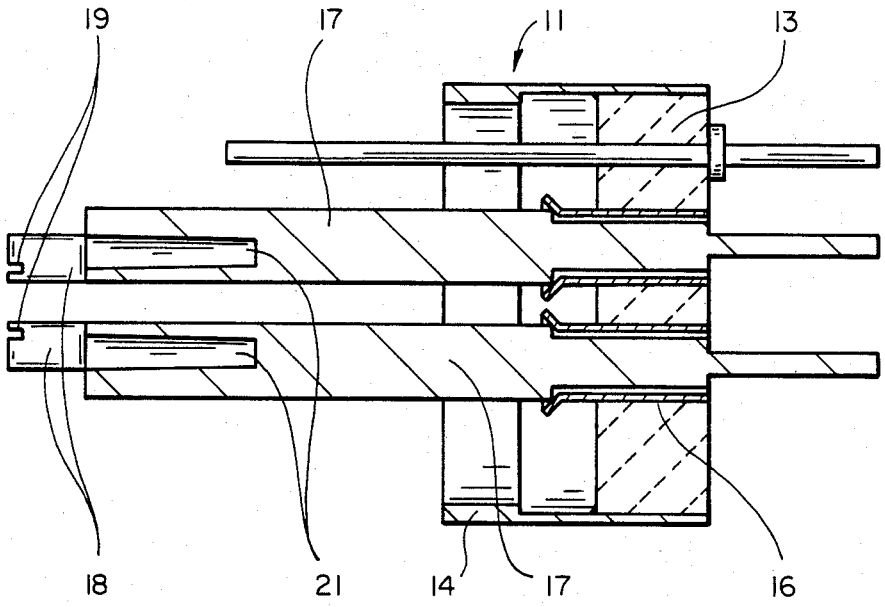
FIG. 3 is a sectional view of the header used in the filament assembly of FIGS. 1 and 2.
Figure 4:
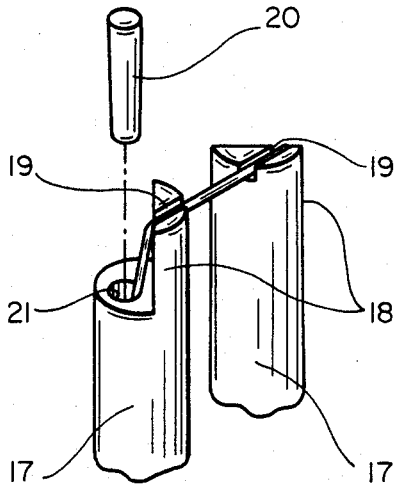
FIG. 4 is a perspective view showing a pair of spaced posts with a filament mounted thereacross.

In accordance with the preferred embodiment of the invention, the ends of each of the posts are machined to provide an extension 18 which includes a positioning slot 19. In the preferred embodiment and as more clearly seen in FIG. 3 the ends of the posts are drilled to form a tapered hole or well 21 adjacent the extension slots 19. A filament is then placed in the positioning slots with the ends extending into the wells 21. Thereafter, a plug or screw 20 (FIG. 4) can be inserted into the holes to firmly engage the ends of the filament and to bring the filament into competent electrical contact with the post. As the plug is inserted into the openings the filament is placed under tension and the posts are urged towards one another whereby they provide a slight spring tension on the filament to maintain the filament in tension.

To lessen the possibility of taper pin welding, the shank is tapered from an ASA screw such that the screw still has a thread, but not the sharpness of the standard thread. This decreases the thermal contact area and thus the total area that can weld and pulls the filament more fully into the well. Since the taper pin or screw and the feedthrough post are the same material, the diameters will expand and contract at the same rate assuming that they are maintained at the same temperature. By expanding and contracting at the same rate, the loosening of the taper pin by temperature cycling is nullified.

As shown there are two pairs of posts suitable for supporting two independent filaments. Electrical connection to the filaments is made to the posts via the pass throughs.

To prevent electrons emitted from the filament to travel to an interior surface of the spectrometer, there is provided a U-shaped shield 22 having a bottom 23 and upwardly extending sides 24. Extensions 26 extend outwardly and are attached to a pair of spaced posts to support the shield.

When both filaments are burned out, the filament can be removed from the equipment by removing the wedge screws or plugs, removing the burned out filament and inserting and engaging a new filament. Thus, the operation to replace a filament is relatively simple and repeatable.

Figure 5:
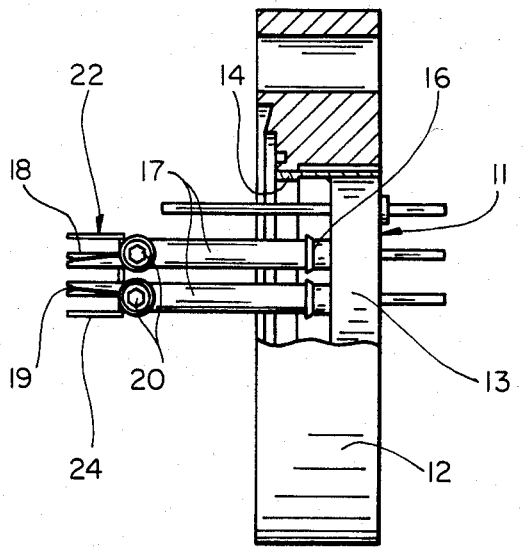
FIG. 5 is a side elevational view partly in section of a filament assembly in accordance with another embodiment of the present invention.
Figure 6:
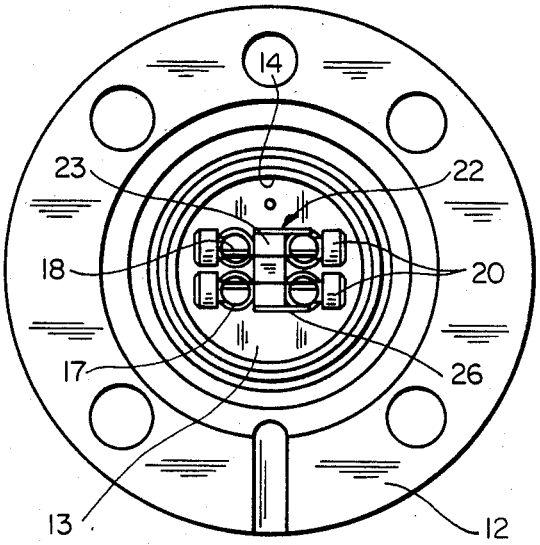
FIG. 6 is a plan view of the filament assembly of FIG. 5.

In the embodiment of FIG. 5, like reference numerals have been applied to like parts. Rather than axial holes or wells 21, there are provided radially extending holes which extend through the posts. The tapered holes are adapted to receive the ends of the filaments where they are secured by screws or plugs.

Thus in each embodiment the filament is easily placed on the filament assembly and easily replaced by merely removing the plugs, inserting a new filament and inserting the plugs, which serve not only to engage and provide competent electrical contact but which also tension the filament for operation. The filament can be accurately and repeatably positioned and tensioned. The problems associated with high temperature cycling are also overcome.

What is claimed is:

1. A filament assembly including:

a header, at least a pair of spaced posts extending through said header, means at the end of each of said post for receiving and positioning a filament so that it extends between the ends of said spaced posts, said posts including tapered holes for receiving the ends of a filament extending past the ends of said posts, and means adapted to be inserted into said tapered holes for releasably securing the ends of the filament to said posts at said holes, said securing means serving to tension the filament as they are inserted into the tapered holes whereby the posts are urged toward one another to maintain the filament in tension.

2. A filament assembly as in claim 1 wherein the tapered holes extend axially in the posts.

3. A filament assembly as in claim 1 wherein the tapered holes extend radially across the posts.

* * * * *